US005598697A

United States Patent [19]

Ambrogi et al.

[11] Patent Number: 5,598,697

[45] Date of Patent: Feb. 4, 1997

[54] DOUBLE WALL CONSTRUCTION FOR A GAS TURBINE COMBUSTION CHAMBER

[75] Inventors: Christine J. M. Ambrogi, Bondoufle; Denis R. H. Ansart, Bois Le Roi; Serge M. Meunier, Le Chatelet En Brie; Denis J. M. Sandelis, Nangis, all of France

[73] Assignee: Societe Nationale d'Etude et de Construction de Moteurs d'Aviation S.N.E.C.M.A., Paris Cedex, France

[21] Appl. No.: 505,633

[22] Filed: Jul. 21, 1995

[30] Foreign Application Priority Data

Jul. 27, 1994 [FR] France ..... 94 09277

[51] Int. Cl.[6] ..... F23R 3/00

[52] U.S. Cl. ..... 60/39.02; 60/752; 60/753

[58] Field of Search ..... 60/39.32, 752, 60/755, 757, 760, 39.02; 415/177, 178

[56] References Cited

U.S. PATENT DOCUMENTS

| | | | |
|---|---|---|---|
| 3,744,242 | 7/1973 | Stettler et al. | 60/750 |
| 4,233,123 | 11/1980 | Hammer et al. | 60/757 |
| 4,392,355 | 7/1983 | Verdouw | 60/752 |
| 4,805,397 | 2/1989 | Barbier et al. | 60/39.32 |
| 4,901,522 | 2/1990 | Commaret et al. | 60/39.32 |
| 4,944,152 | 7/1990 | Shekleton | 60/757 |
| 5,065,817 | 11/1991 | Alvarez et al. | 29/890.037 |
| 5,201,847 | 4/1993 | Whidden | 415/177 |

FOREIGN PATENT DOCUMENTS

| | | |
|---|---|---|
| 0248731 | 12/1987 | France . |
| 0321320 | 6/1989 | France . |
| 636818 | 5/1950 | United Kingdom . |
| 636811 | 5/1950 | United Kingdom . |
| WO92/16798 | 10/1992 | WIPO . |

OTHER PUBLICATIONS

Lefebvre, Arthur H. *Gas Turbine Combustion.* New York, N.Y.: McGraw–Hill, 1983. pp. 300–301.

*Primary Examiner*—Timothy S. Thorpe
*Attorney, Agent, or Firm*—Bacon & Thomas

[57] ABSTRACT

A wall structure for a wall bounding a combustion chamber of a gas turbine engine is disclosed having a first wall with an inner surface facing towards the interior of the combustion chamber and an outer surface facing away from the interior of the combustion chamber such that the inner surface forms a boundary of the combustion chamber and the outer surface has a surface roughness to prevent the formation of a fluid flow cooling layer which would cool the outer surface. The invention also has a second wall spaced from the outer surface of the first wall in a direction away from the interior of the combustion chamber so as to define a cooling fluid circulatory space between the first and second walls. A plurality of first perforations extend through the first wall in communication with the cooling fluid circulatory space to enable passage of cooling fluid from the space through the first perforations to form a cooling fluid film on the inner surface of the first wall.

9 Claims, 2 Drawing Sheets

DOUBLE WALL CONSTRUCTION FOR A GAS TURBINE COMBUSTION CHAMBER

BACKGROUND OF THE INVENTION

The present invention relates to the structure of a wall bounding the combustion chamber of a gas turbine engine, more particularly such a structure having a double wall construction.

Military and civilian use turbojet engines have used ever increasing compression ratios in their compressors which generate higher temperature gases at the high pressure compressor output, the combustion chamber and the high pressure turbine. Accordingly, the combustion chambers of these engines must be appropriately cooled because, as their output increases, the air flow available for cooling decreases.

Present gas turbine engine combustion chambers may be comprised of a double wall construction using internal tiles to minimize heat transfer from the combustion gases to the combustion chamber wall. Such tiles may be made of a ceramic material, such as SiC/SiC. Because such materials have little thermal conductivity, high cooling is required. It is furthermore known that the temperatures near the combustion chamber exit are critical for maximum engine performance. Thus, effective cooling of the combustion chamber while lowering the air flow necessary for such cooling is imperative.

SUMMARY OF THE INVENTION

A wall structure for a wall bounding a combustion chamber of a gas turbine engine is disclosed having a first wall with an inner surface facing towards the interior of the combustion chamber and an outer surface facing away from the interior of the combustion chamber such that the inner surface forms a boundary of the combustion chamber and the outer surface has a surface roughness to prevent the formation of a fluid flow cooling layer which would cool the outer surface. The invention also has a second wall spaced from the outer surface of the first wall in a direction away from the interior of the combustion chamber so as to define a cooling fluid circulatory space between the first and second walls. A plurality of first perforations extend through the first wall in communication with the cooling fluid cirulatory space to enable passage of cooling fluid from the space through the first perforations to form a cooling fluid film on the inner surface of the wall.

The second wall may be formed from a plurality of files having an edge engaged in a housing formed by a flange extending from the outer surface of the first wall. A mounting device may be located in the housing between the edge of the tile and the flange to permit relative expansion and contraction between the first and second walls due to their different thermal conductivities.

An object of the present invention is to provide a combustion chamber, in particular such a chamber for a gas turbine engine, which comprises a generally axially extending double wall which comprises an inner, or first, wall having a plurality of cooling perforations and an outer, or second, wall spaced away from the inner wall so as to define a circulation space between them for a cooling fluid which may comprise the oxidizer fed to the combustion chamber. The outer surface of the inner wall has a surface roughness to enhance heat dissipation from the inner, or first, wall material.

The surface roughness may be imparted to the outer surface of the inner, or first, wall by a particle bombardment operation, such as shot blasting or sand blasting, in order to achieve a roughness Ra higher than 5, and preferably approximating 6.3.

The inner wall has annular flanges projecting outwardly from the outer surface to define a housing which accepts upstream edges of the tiles which form the outer, or second, wall. The tiles may also define a plurality of cooling perforations which, in conjunction with holes extending through the flange, allow cooling fluid, such as oxidizer, to pass into the cooling fluid circulatory space between the first and second walls. It is also possible for the inner, or first, wall to have a mounting flange at its downstream end portion which may be attached to an outer engine housing. Passages may be formed through the mounting flange which enable unused cooling fluid to exit from the cooling fluid circulatory space through the hole in the mounting flange and into the engine housing.

The primary advantage of the combustion chamber wall structure according to the present invention is its ability to withstand high temperatures because of effective dissipation of the heat to which the walls are subjected.

DETAILED DESCRIPTION OF THE PREFERRED EMBODIMENTS

Figure 1:
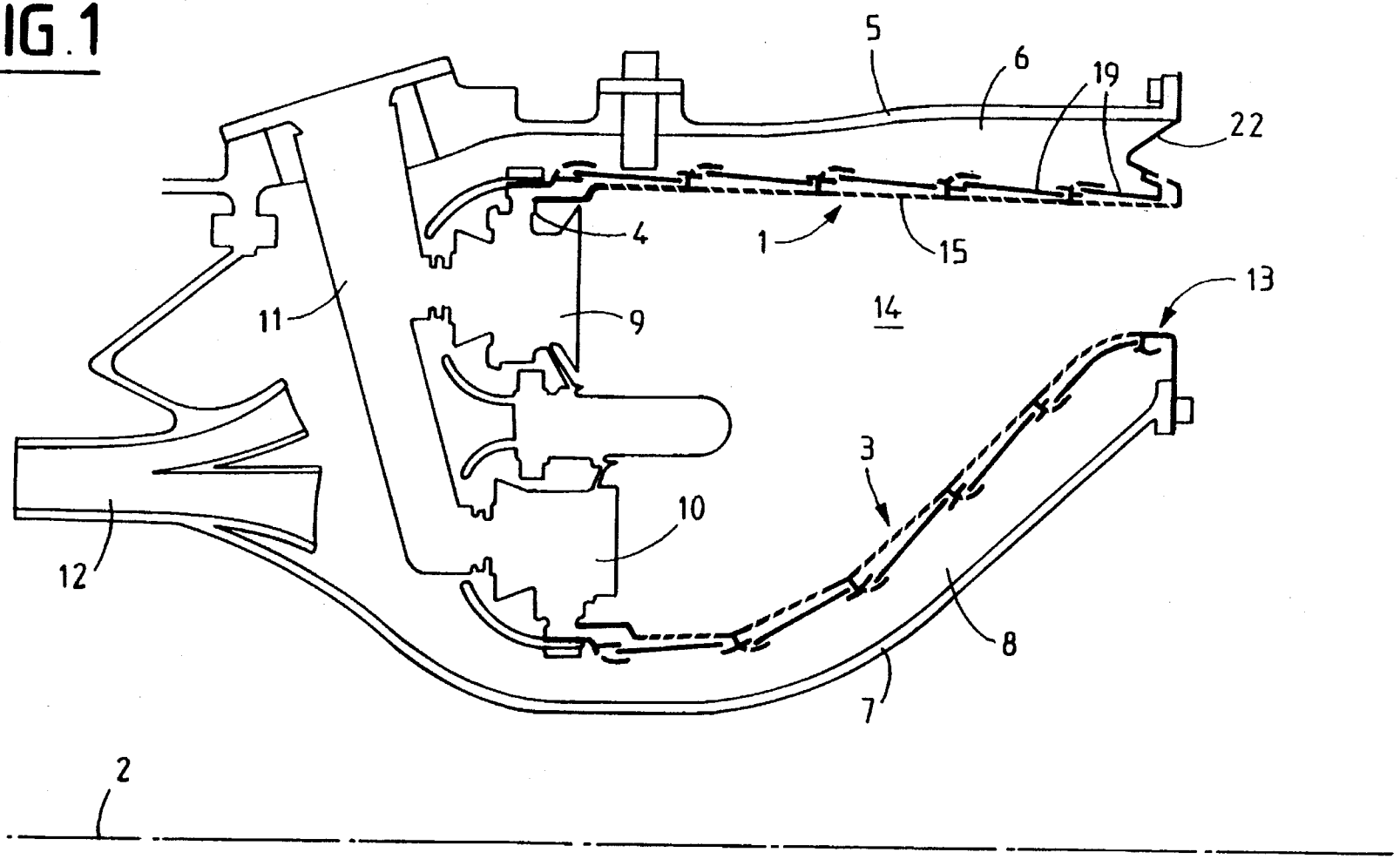
FIG. 1 is a partial, axial cross-sectional view of a combustion chamber according to the present invention.

The combustion chamber according to the present invention, as seen in FIG. 1, comprises a double outer wall structure 1 that generally concentrically extends about longitudinal axis 2, a double inner wall 3 that also extends concentrically about longitudinal axis 2 and a combustion chamber end wall 4 which interconnects the upstream, or forward, ends of the double walls 1 and 3. This structure is enclosed within an outer casing 5 which extends concentrically about axis 2, which along with double outer wall 1, defines a first annular space 6. An inner casing 7 is located between the axis 2 and the double inner wall 3 and, along with the double inner wall 3, bounds a second annular space 8. The combustion chamber assembly comprises two known fuel injector assemblies, schematically illustrated at 9 and 10, which are supported on the chamber end wall 4 in known fashion and which are connected to a fuel feed system 11 also in known fashion. Oxidizer, which is typically air, is fed from a high pressure compressor (not shown) through oxidizer intake 12 and passes into the spaces 6 and 8. The combustion chamber assembly has exhaust gas orifice 13 located at a downstream extremity to exhaust gases from the combustion chamber 14. In known fashion, such exhaust gases are directed on to a gas turbine (not shown) which may be located downstream (toward the fight as viewed in FIG. 1) of the exhaust orifice 13. As can be seen, the combustion chamber 14 is bounded by the double outer and inner walls 1 and 3, respectively, and by the upstream end wall 4.

Figure 2:
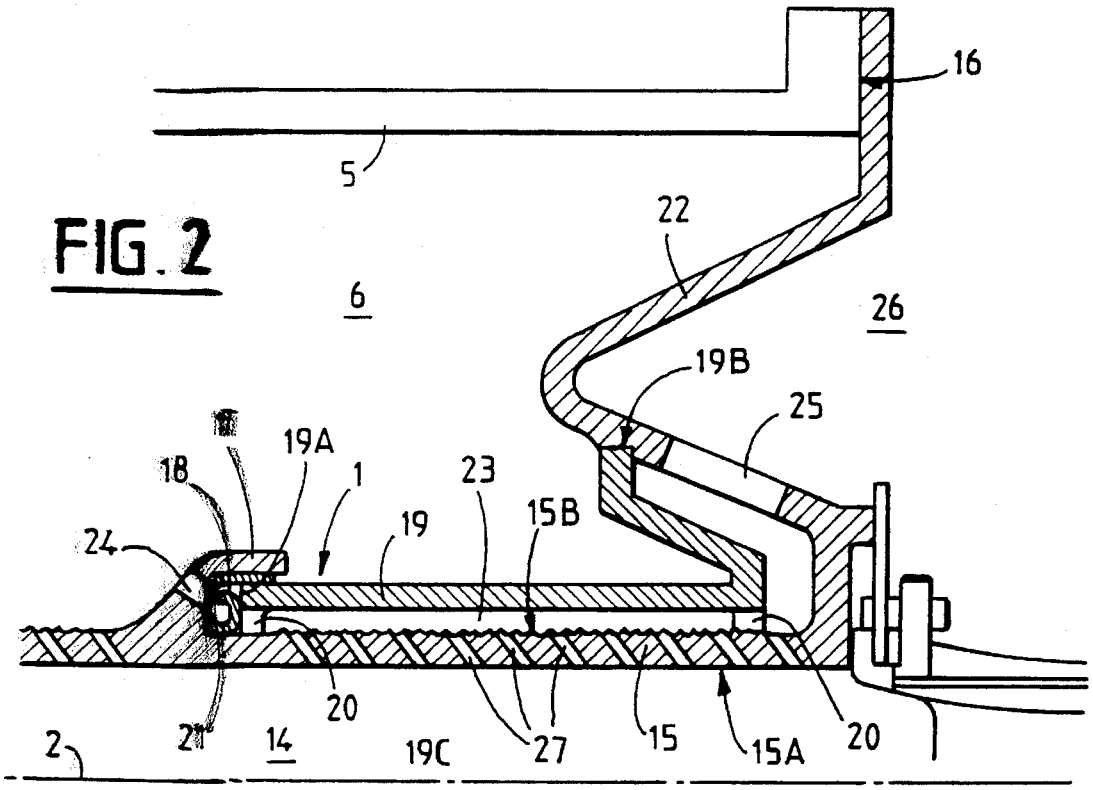
FIG. 2 is a partial, cross-sectional view illustrating a first embodiment of the double wall structure.
Figure 3:
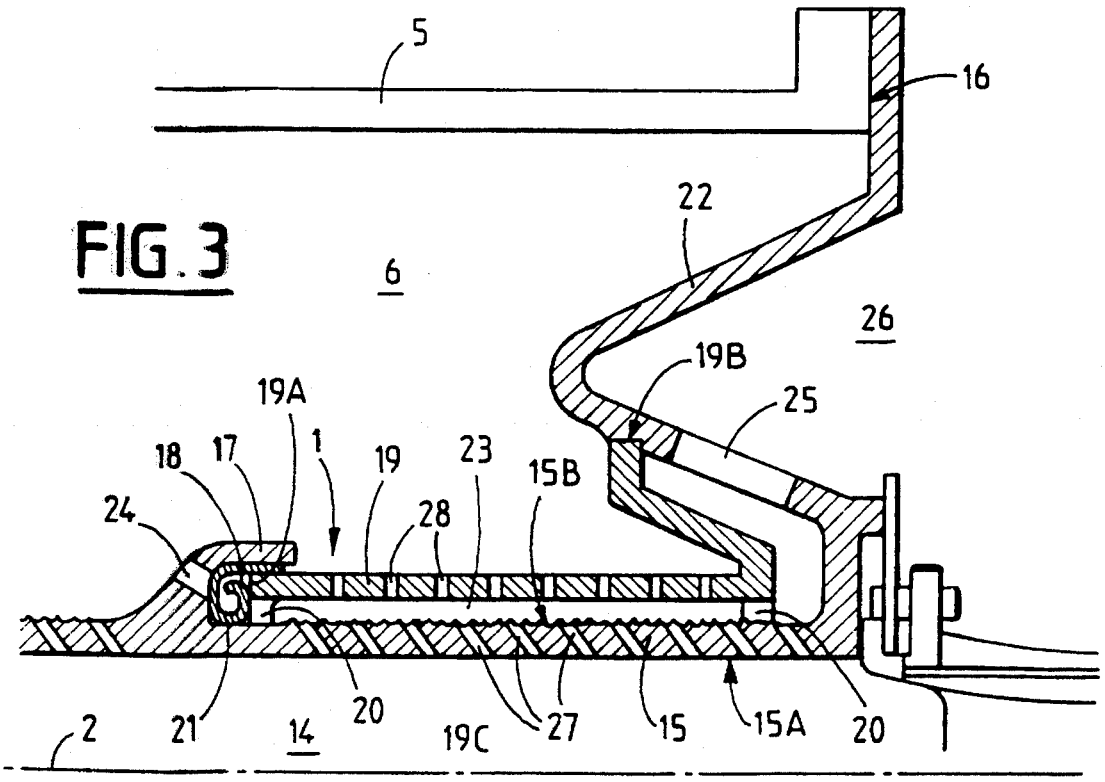
FIG. 3 is a cross-sectional view similar to FIG. 2, illustrating a second embodiment of the double wall construction according to the present invention.

Each double wall 1 and 3 has the construction of one of the embodiments illustrated in FIGS. 2 and 3. FIGS. 2 and 3 illustrate a downstream portion of the double outer wall 1 wherein this portion is located immediately upstream of the gas turbine rotor wheel, although it is to be understood that other portions of the double wall 1, as well as the inner double wall 3, are similarly configured.

In the embodiment of FIG. 2, the wall structure comprises a first, or inner, wall 15 which extends concentrically about longitudinal axis 2 which has a mounting flange 22 extending therefrom which is connected to the downstream end 16 of the outer casing 5. The inner surface 15A of the first wall 15 forms am outer boundary of the combustion chamber 14. A flange 17 extends from the outer surface 15B of the inner wall 15 and, again, extends about longitudinal axis 2, so as to form a housing 18.

A second, or outer, wall may be formed from a plurality of tiles 19 which are fitted with supports 20 supporting the tiles 19 on the outer surface 15B of the inner wall 15 so as to define a cooling fluid circulatory space 23 therebetween. The tiles 19 have an upstream edge 19A that is inserted into the housing 18 wherein it is held by mounting device 21 and by engagement of its downstream extremity 19B with the mounting flange 22. The supports 20 keep the inner surface of each tile 19 spaced away from the outer surface 15B to define the cooling fluid circulatory space 23. The cooling fluid circulatory space 23 communicates with the annular space 6 via a plurality of holes 24 formed in the flange 17. At least one passage 25 formed in the mounting flange 22, allows the cooling circulatory space 23 to communicate with the gas turbine enclosure 26. The space 23 also communicates with the combustion chamber 14 via a plurality of cooling perforations 27 extending through the inner wall 15 between the inner surface 15A and the outer surface 15B.

As can be seen in FIG. 2, the outer surface 15B of the first wall 15 is a rough surface with a roughness Ra exceeding 5 and preferably approximating 6.3. The rough surface 15B may be made by particle blasting the outer surface 15B by either a shot blasting or a sand blasting process.

The embodiment illustrated in FIG. 3 is identical to the previously described embodiment in FIG. 2, with the exception of a plurality of second perforations 28 extending through the tiles 19 in communication with the annular space 6 and the cooling fluid circulatory space 23. The multiple perforations 28 are similar to the perforations 27 in the wall 15 in that they both comprise multiple perforations.

In the described embodiment in FIG. 2, the compressed oxidizer, or air, present in the annular space 6 passes through at least one hole 24 formed in the flange 17 to enter the cooling fluid circulatory space 23. Part of this oxidizer, or air, enters the combustion chamber 14 and, by flowing along the inner surface 15A of the wall 15, it forms a fluid film cooling the surface 15A. The remainder of the fluid within space 23 is exhausted through the passage 25 and may be used for cooling the high pressure turbine blading (not shown) within the space 26.

The roughness of the outer surface 15B of the inner wall 15 precludes the formation of a flow layer which would cool the surface 15B. This feature enhances the efficiency in dissipating heat from, and in cooling the first wall 15. Moving the coolant into space 23 in such a manner that it strikes the rough outer surface 15B, along with the tile 19 located outside of the combustion chamber 14, permits the present invention to achieve improved cooling efficiency.

The mounting device 21 inserted between the upstream edge 19A of the tiles 19 and the flange 17 allows relative expansion and contraction of the inner wall 15 and the tiles 19, due to their differing thermal conductivities.

The wall structures according to the present invention may be applied to various walls of the combustion chamber and finds most benefit by being applied to those most subjected to thermal stresses, namely the downstream wall portion adjacent to the gas turbine rotor wheels. The present invention enables the temperature to be lowered by 40°–50° C. and further enables the weight of the assembly to be reduced because of the possibility of using less dense tiles 19 (such as those made of composite or similar materials) since they must withstand temperatures of approximately 700° C.

Moreover, the present invention eliminates the hot gas leaks of the prior art structures which occurred between the interior tiles. In the present invention, the tiles are now mounted outside of an inner wall 15 which bounds the combustion chamber 14. The efficiency of the gas turbine engine is improved by the present invention insofar as it recovers at least a portion of the cooling fluid exhausted from the space 23 into the space 26 enclosing the high temperature gas turbine.

The foregoing description is provided for illustrative purposes only and should not be construed as in any way limiting this invention, the scope of which is defined solely by the appended claims.

We claim:

1. A wall structure for a wall bounding a combustion chamber of a gas turbine engine comprising:

a) an inner wall having an inner surface facing towards an interior of the combustion chamber and an outer surface facing away from the interior of the combustion chamber, the inner surface forming a boundary of at least a portion of the combustion chamber;

b) an outer wall spaced from the outer surface of the inner wall in a direction away from the interior of the combustion chamber so as to define therebetween a cooling fluid circulatory space, having a forward end and through which circulates a cooling fluid, the outer wall comprising a plurality of files, each tile having supports thereon supporting the tiles on the outer surface of the inner wall, whereby only the outer surface of the inner wall in the cooling fluid circulatory space has a surface roughness Ra of greater than 5;

c) at least one hole in communication with the forward end of the cooling fluid circulatory space to enable passage of a cooling fluid into the cooling fluid circulatory space; and d) a plurality of first perforations extending through the inner wall in communication with the cooling fluid circulatory space and the combustion chamber to enable passage of the cooing fluid therethrough to form a cooling fluid film on the inner surface to cool same.

2. The wall structure of claim 1 wherein each file has an edge and further comprising a flange extending from the outer surface of the inner wall forming a housing into which is inserted the edge of the tile.

3. The wall structure of claim 2 further comprising a mounting device inserted between the edge of the tile and a corresponding housing so as to allow relative thermal expansion between the tile and the inner wall.

4. The wall structure of claim 2 further comprising at least one through hole extending through the flange so as to communicate with the cooling fluid circulatory space so as to permit a cooling fluid to flow into the cooling fluid circulatory space.

5. The wall structure of claim 1 further comprising a plurality of second perforations extending through the tiles of the outer wall in communication with the cooling fluid circulatory space.

6. The wall structure of claim 1 wherein the roughness Ra of the outer surface is approximately 6.3

7. A method of making a wall structure for a wall bounding a combustion chamber of a gas turbine engine having: an inner wall having an inner surface facing towards an interior of the combustion chamber; an outer wall spaced from the outer surface of the inner wall in a direction away from the interior of the combustion chamber so as to define therebetween a cooling fluid circulatory space through which circulates a cooling fluid, the outer wall comprising a plurality of tiles, each tile having supports thereon supporting the tiles on the outer surface of the inner wall, whereby only the outer surface of the inner wall in the cooling fluid circulatory space has a surface roughness Ra of greater than 5; at least one hole in communication with the forward end of the cooling fluid circulatory space to enable passage of a cooling fluid into the cooling fluid circulatory space; and a plurality of first perforations extending through the inner wall in communication with the cooling fluid circulatory space and the combustion chamber to enable passage of the cooing fluid therethrough to form a cooling fluid film on the inner surface to cool same wherein the roughness of the outer surface is achieved by particle bombardment of the outer surface.

8. The method of claim 7 wherein the particle bombardment comprises the step of shot blasting.

9. The method of claim 7 wherein the particle bombardment comprises the step of sand blasting.

* * * * *